United States Patent [19]

Katzenberger

[11] 3,995,867

[45] Dec. 7, 1976

[54] PROCESS FOR PRODUCING LIGHT WEIGHT CONCRETE

[76] Inventor: Helmut Katzenberger, Archenweg 52, 6020 Innsbruck, Austria

[22] Filed: May 6, 1975

[21] Appl. No.: 574,938

[30] Foreign Application Priority Data

May 6, 1974 Austria ..... 3695/74

[52] U.S. Cl. ..... 259/148; 259/164; 259/24

[51] Int. Cl.[2] ..... B28C 5/00

[58] Field of Search ..... 141/67, 7; 259/146–149, 259/23, 24, 164

[56] References Cited

UNITED STATES PATENTS

| | | | |
|---|---|---|---|
| 3,118,656 | 1/1964 | Witt | 259/146 |
| 3,348,818 | 10/1967 | Avril | 259/148 |
| 3,467,151 | 9/1969 | Vogt | 141/67 |
| 3,473,788 | 10/1969 | Kelly | 259/149 |
| 3,547,412 | 12/1970 | Klages | 259/148 |
| 3,589,686 | 6/1971 | Russell | 259/148 |
| 3,669,417 | 6/1972 | Cornwell | 259/147 |
| 3,693,672 | 9/1972 | Hiland | 141/7 |

*Primary Examiner*—Robert I. Smith
*Attorney, Agent, or Firm*—Wenderoth, Lind & Ponack

[57] ABSTRACT

A process and apparatus for producing light weight concrete including a binding agent, an inorganic aggregate and foamed plastic material, whereby the granulated plastic material is supplied to the concrete mixer via a metering mechanism. In a transfer container which is arranged in the supply system for the granulated material, the granulated material is put under a pressure higher than the pressure in the mixer in order to guarantee an exact introduction of the granulated material into the mixer.

13 Claims, 2 Drawing Figures

PROCESS FOR PRODUCING LIGHT WEIGHT CONCRETE

BACKGROUND OF THE INVENTION

The invention relates to a process for producing light weight concrete including a binding agent, e.g. cement, an inorganic aggregate, e.g. sand, and foamed plastic material, e,g. foamed polystyrene, whereby the granulated plastic material is supplied into the mixer by a metering mechanism.

Furthermore the invention relates to a device for the realisation of this process and comprising a mixer and supply means for the granulated plastic material.

In the production of light weight concrete with admixtures of foamed plastic material, e.g. foamed polystyrene, it has proven to be an advantage to foam up the plastic material directly in the concrete mixer itself.

The foaming up of the plastic material is carried out under a certain pressure, which, in the case of polystyrene, ranges between 0.0 and 0.5 atm gage, and at a certain temperature which is 100° – 110° C according to prior art.

The supply of the granulated plastic material causes difficulties due to the pressure conditions in the mixer. According to prior art it is practically necessary to reduce the pressure in the mixer before the granulated material is added, i.e. before every mixing turn, a fact that causes considerable losses in time and energy.

Another reason for which it is impossible according to prior art to introduce the granulated plastic material into the mixer, which is under a certain pressure, is constituted by the fact that congestions and agglomeration of lumping can occur at the inlet into the mixer. The consequences of this disadvantage are difficulties in production and weak zones in the concrete due to the agglomeration.

SUMMARY OF THE INVENTION

Therefore the object of the present invention is to provide a process according to which it is possible to introduce granulated plastic material from a reservoir under low pressure into a mixer which is at a lower pressure.

Furthermore it is an object of the invention to provide a device for the realisation of this process according to the invention.

The process according to the invention is characterized in that the granulated plastic material is exposed to a pressure higher than that in the mixer before it is introduced into the mixer.

The device according to the invention is characterized in that a transfer container is provided in the supply system for the granulated plastic material upstream of the mixer, in which container a pressure higher than that in the mixer can be established.

According to the invention the pressure in the transfer container is produced by means of compressed air which is guided into the transfer container by corresponding nozzles.

According to the invention it would also be possible to use steam in combination with other appropriate measures to inhibit an undesired formation of clumps or agglomeration.

In a preferred embodiment of the invention the pressure in the mixer is provided to range between 0.0 and 0.5 atm gage while the pressure in the transfer container is provided to be 0.7 atm gage.

In this connection it should also be mentioned, however, that the invention is not meant to be limited to these given pressure levels, the pressure in the transfer container depending solely from the pressure in the mixer and the fact that a difference in pressure between the transfer container and the mixer is necessary.

An embodiment of the invention provides a check valve between the transfer container and the silo for the granulated material.

Furthermore the invention provides an intake valve between the transfer container and the mixer, such valve being controlled by a manometre or the like which is arranged in the transfer container.

In order to ensure that the transfer container is completely emptied of the granulated plastic material, one embodiment of the invention provides at least one cleaning nozzle in the transfer container, which cleaning nozzle sweeps the walls of the container by means of compressed air.

BRIEF DESCRIPTION OF THE DRAWINGS

The invention is described hereinafter with reference to the attached drawing, although the invention is not meant to be limited to the specific embodiment represented.

DETAILED DESCRIPTION OF THE INVENTION

Figure 1:
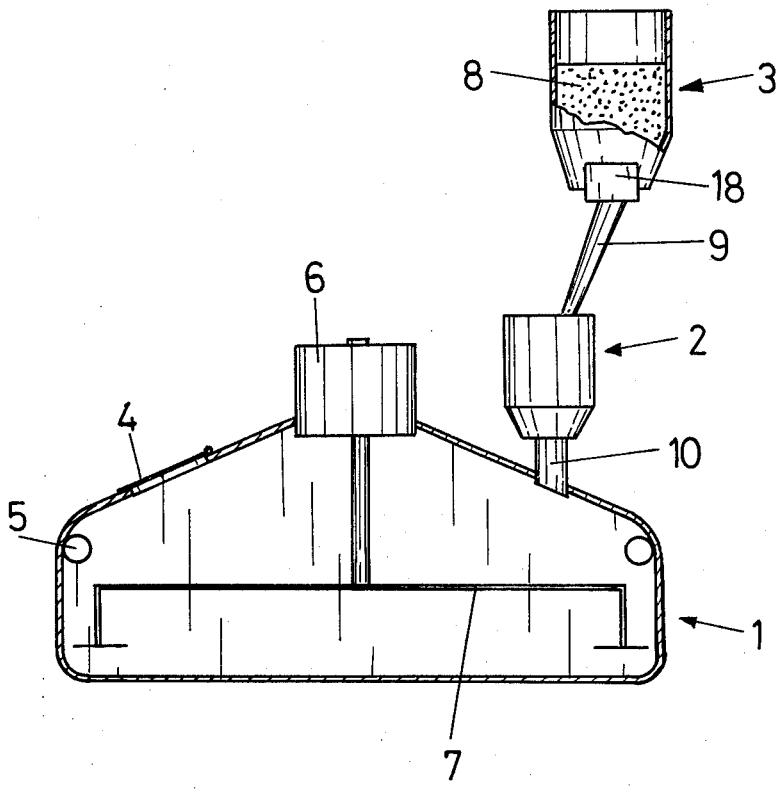
FIG. 1 is a schematic partial section view of a device according to the invention.

As can be seen from FIG. 1 the device according to the invention comprises a silo 3 for the granulated plastic material 8, a dosing or metering mechanism 18, e.g. scales, a supply means or conduit 9 extending from silo 3 to the transfer container 2 and a supply means or conduit 10 extending from the transfer container 2 to the mixer 1 itself.

Within the mixer 1 there is provided a mixing tool 7 and an engine 6 for operating the mixing tool 7. A tube 5 for the supply of steam, and an inlet opening 4 for the supply of other aggregates, e.g. sand, are provided.

According to the invention the metering mechanism 18 measures out a certain amount of granulated plastic material 8 which is then transported from the silo 3 through the supply means 9 into the transfer container 2.

Figure 2:
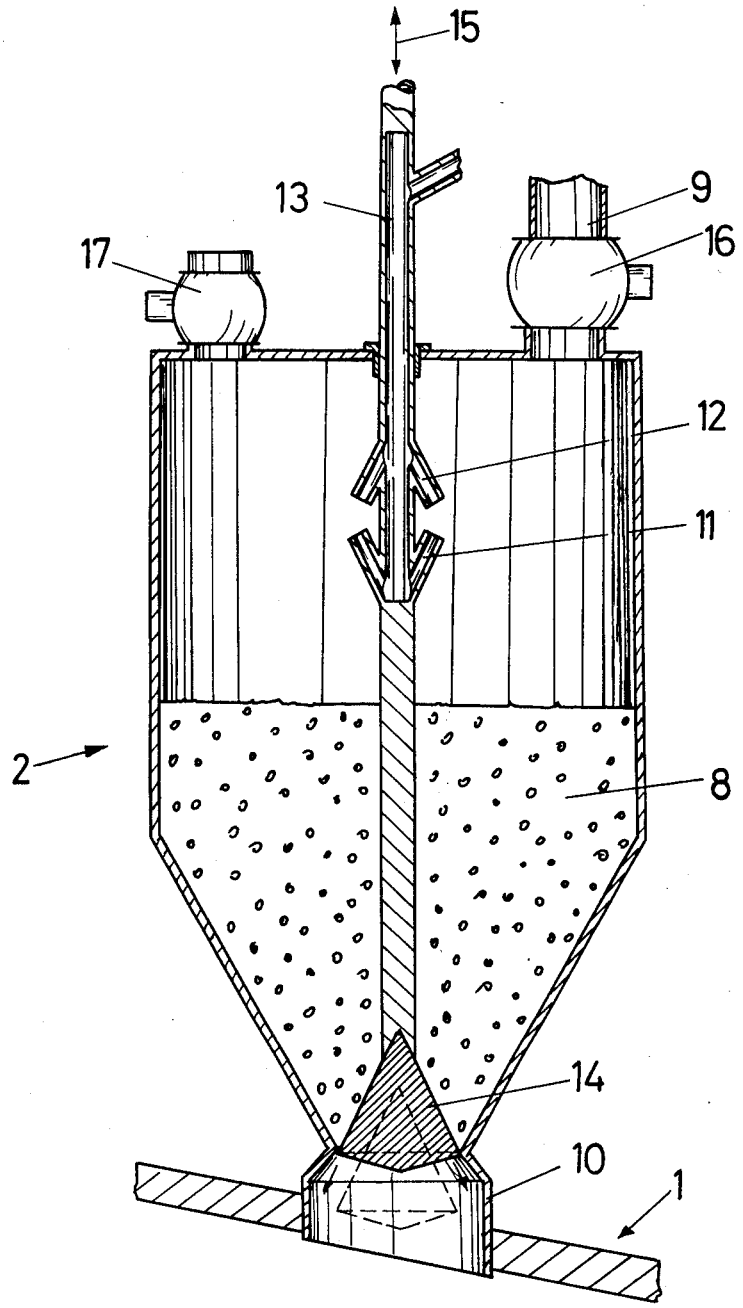
FIG. 2 is a schematic longitudinal section of a portion of the device according to the invention.

This is done with a pressure in the mixer 1 of e.g. 0.5 atm gage and with the transfer container 2 closed from communication with the mixer 1 by a valve 14 represented in FIG. 2 as a cone-shaped valve.

At that moment the pressure in the transfer container 2 is substantially equal to that in the silo 3 for the granulated plastic material 8.

Subsequently compressed air is injected into the transfer container 2 through the nozzles 11 and the conduct 13.

The nozzles 11 are directed upwards in order to avoid stirring up the granulated plastic material in the container.

At the inlet 9 for the granulated plastic material 8 a check valve 16 is provided firstly for permitting the pressure in the transfer container 2 to be established, and secondly for preventing the granulated plastic material from being projected back into the silo 3.

As soon as the pressure in the transfer container 2 has reached the desired level, e.g. in the embodiment represented 0.7 atm gage, the valve 14 is displaced to the dashed line position of FIG. 2, as shown by arrow 15, by an appropriate mechanism (not illustrated).

Due to the relatively lower pressure in the mixer 1 than in container 2 the granulated plastic material 8 is drawn into the mixer 1 by suction effect.

After the transfer container 2 has been emptied and eventually cleaned of the granulated material by the nozzles 12, the valve 14 is again closed, and the pressure balancing valve 17 is opened in order to return the pressure in the transfer container 2 to substantially the level of the pressure in the silo 3.

The process and apparatus according to the invention offer the following advantages: The granulated plastic material 8 is introduced into the mixer 1 in an exact manner and without deficiencies. By building up a pressure in the container 2 and by the rotation of the mixing tool in the mixer the granulated material is regularly distributed in the mixer, and the undesired welding of expanded granulated material is almost completely avoided. Finally, the container is routinely automatically cleaned by the currents of air in the container the effect of which can be improved by the nozzles 12.

Various modifications may be made without departing from the scope of the invention.

What I claim is:

1. In a process for the production of light weight concrete from materials including a binding agent, an inorganic aggregate and a foamed plastic material, wherein a predetermined quantity of granulated plastic material is metered from a reservoir, through a supply means into a concrete mixer operating at a pressure above atmospheric pressure, the improvement comprising:

subjecting the metered quantity of granulated plastic material, while in said supply means, to a pressure higher than the pressure in said mixer; and then transferring said granulated plastic material from said supply means to said mixer and foaming said plastic material in said mixer.

2. The improvement claimed in claim 1, wherein said step of subjecting comprises positioning said metered quantity of granulated plastic material in a transfer container which is isolated from said mixer; then introducing air into said transfer container to raise the pressure therein.

3. The improvement claimed in claim 2, wherein the pressure in said mixer is maintained below 0.5 atm gage; and said step of introducing comprises raising said pressure in said transfer container to 0.7 atm gage.

4. The improvement claimed in claim 2, wherein said step of transferring comprises opening communication between said transfer container and said mixer, and causing said metered granulated plastic material to move to said mixer due to the difference in pressures between said transfer container and said mixer.

5. The improvement claimed in claim 4, further comprising, after said step of transferring, introducing air into said transfer container against the walls thereof to remove any residual of said metered granulated plastic material therefrom and into said mixer.

6. In a device for producing light weight concrete from materials including a binding agent, an inorganic aggregate, and a foamed plastic material, said device being of the type including a concrete mixer operating at a pressure above atmospheric pressure, a reservoir for metering a predetermined quantity of granulated plastic material, and supply means for supplying the metered granulated plastic material to said mixer; the improvement wherein:

said supply means includes means for raising the pressure of said metered granulated plastic material to a pressure higher than the pressure in said mixer; and means for transferring the thus raised-pressure metered granulated plastic material into said mixer whereat said plastic material is foamed.

7. The improvement claimed in claim 6, wherein said supply means further comprises a transfer container, and means for transporting said metered granulated plastic material from said reservoir to said transfer container.

8. The improvement claimed in claim 7, wherein said pressure raising means comprises means for introducing air into said transfer container.

9. The improvement claimed in claim 7, wherein said transferring means comprises intake valve means positioned for selectively opening and closing communication between said transfer container and said mixer.

10. The improvement claimed in claim 9, further comprising a manometer measuring the pressure in said transfer container, said intake valve means being connected to and controllable by said manometer.

11. The improvement claimed in claim 7, further comprising a check valve in said transporting means.

12. The improvement claimed in claim 7, further comprising a pressure balancing valve in said transfer container.

13. The improvement claimed in claim 7, further comprising cleaning nozzle means for selectively removing residual metered granulated plastic material from the walls of said transfer container.

* * * * *